US005775838A

United States Patent [19]

Pettee, Sr.

[11] Patent Number: 5,775,838

[45] Date of Patent: Jul. 7, 1998

[54] BLOCK BLANKET EROSION CONTROL SYSTEM

[76] Inventor: Gary K. Pettee, Sr., 16870 Straight Way, Genoa, Ill. 60135

[21] Appl. No.: 597,924

[22] Filed: Feb. 7, 1996

[51] Int. Cl.[6] ..... E02B 3/12

[52] U.S. Cl. ..... 405/20; 405/16; 405/17

[58] Field of Search ..... 405/16–20, 32–35; 404/35–43

[56] References Cited

U.S. PATENT DOCUMENTS

| | | | |
|---|---|---|---|
| 589,856 | 9/1897 | Rabitz | 405/16 |
| 2,047,197 | 7/1936 | Fordyce | 405/19 |
| 2,502,757 | 4/1950 | Shearer | 405/17 |
| 2,674,856 | 4/1954 | Loucks | 405/20 |
| 4,152,875 | 5/1979 | Soland | 405/19 X |
| 4,375,928 | 3/1983 | Crow et al. | 405/17 X |
| 4,436,447 | 3/1984 | Crowe | 405/32 X |
| 4,651,975 | 3/1987 | Howell | 405/32 |

FOREIGN PATENT DOCUMENTS

| | | | |
|---|---|---|---|
| 2164929 | 6/1990 | Japan | 405/258 |

*Primary Examiner*—Dennis L. Taylor
*Attorney, Agent, or Firm*—Kajane McManus

[57] ABSTRACT

The erosion control blanket of blocks comprises a plurality of concrete blocks having a preselected configuration and being joined to adjacent blocks of the configuration by at least one of a plurality of embodiments of a reinforcing lattice structure. Individual blankets may be joined together to create a desired configuration for a substrate covering. Provision of the blocks in a blanket configuration provides a process of laying the blocks with attached lattice which is time and labor saving.

12 Claims, 3 Drawing Sheets

FIG. 1
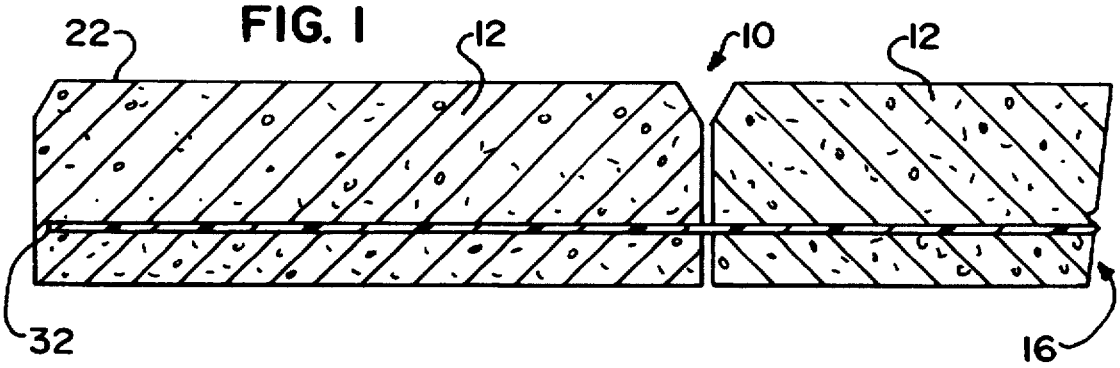
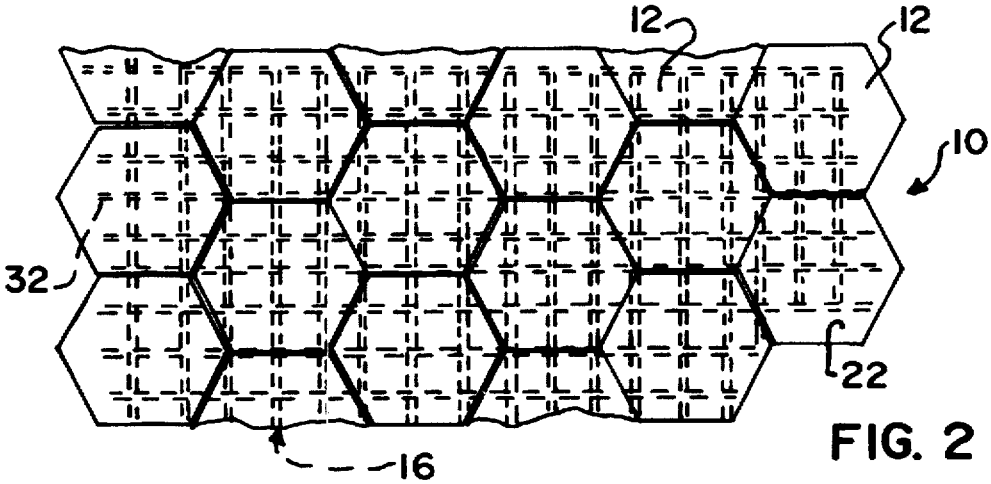
FIG. 2
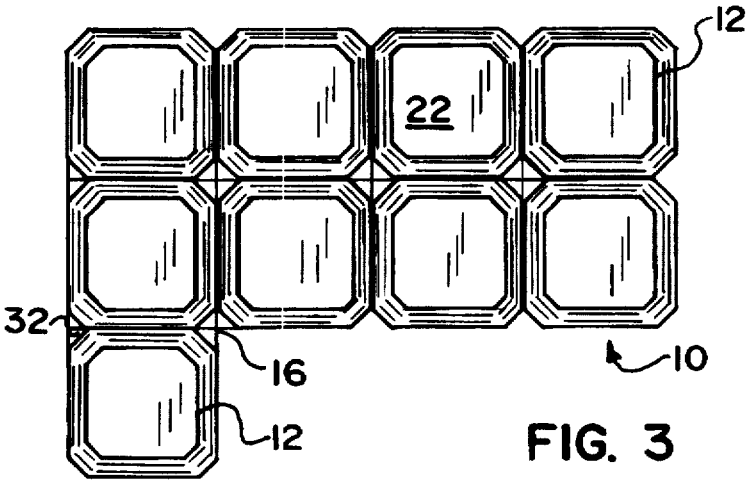
FIG. 3

BLOCK BLANKET EROSION CONTROL SYSTEM

BACKGROUND OF THE INVENTION

1. Field of the Invention

The present invention relates to an erosion control system comprising a blanket of blocks, the blanket being made of individual blocks held together by a reinforcement system appropriate for the substrata upon which the blanket is to rest, such blocks typically being cast of concrete.

2. Description of the Prior Art

Heretofore, various single block erosion control systems have been proposed for use on various substrata.

Examples of such systems may be found in following U.S. Patents.

| U.S. Pat. No. | Patentee |
|---|---|
| 3,894,397 | Fair |
| 3,903,702 | Appleton |
| 4,227,829 | Landry |
| 4,370,075 | Scales |

All these systems disclose complex single block structures which are to be placed adjacent each other and interconnected by hand on site, a time consuming labor intensive process. Further, none of these patents disclose the use of control-specific reinforcement systems for accommodating the various substrata forms which typically require such erosion control.

SUMMARY OF THE INVENTION

Accordingly it is a primary object of the invention to provide an erosion control system which is less time consuming and labor intensive to install, and yet capable of accommodating all types of substrata by providing a suitable substrata-specific reinforcement lattice for the system.

This is accomplished by the block blanket system of the present invention which provides a plurality of blocks joined together by a reinforcing lattice into a blanket or mattress structure, with the reinforcement lattice configuration being specifically selected for the particular substrata to be dealt with.

BRIEF DESCRIPTION OF THE DRAWINGS

FIG. 1 is a cross sectional view through two adjoining blocks of the blanket of the present invention showing one combination embodiment of reinforcing lattice used to create the blanket from individual blocks.

FIG. 2 is a top view of a portion of a blanket and one embodiment of the blocks of the blanket showing the lattice in phantom.

FIG. 3 is a top plan view of a portion of another blanket showing a further embodiment of the blocks.

DESCRIPTION OF THE PREFERRED EMBODIMENTS

Figure 4:
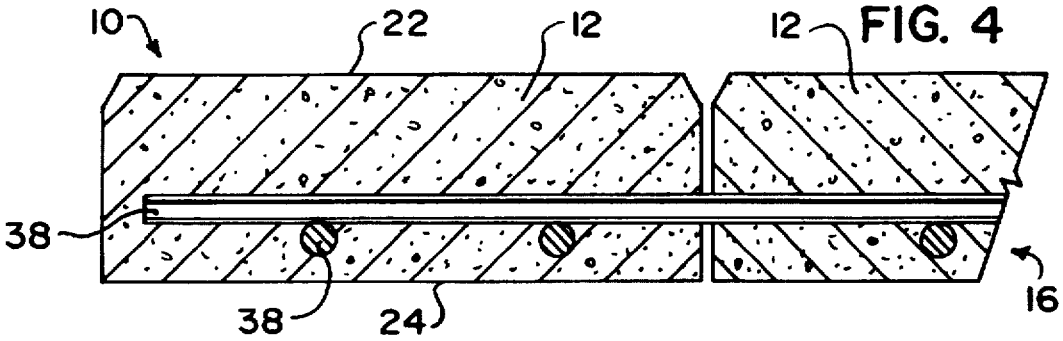
FIG. 4 is a cross sectional view similar to FIG. 1 showing a further lattice embodiment.
Figure 5:
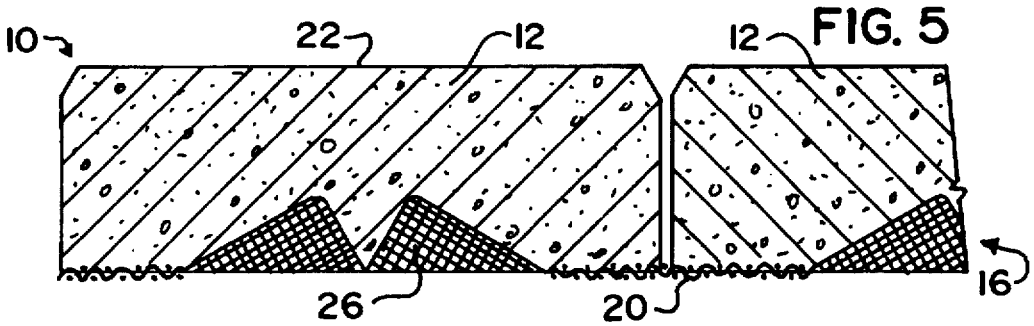
FIG. 5 is similar to FIG. 4 showing a further lattice embodiment.

Referring now to the drawings in greater detail there is illustrated therein a plurality of embodiments of the blanket of the present invention generally identified by the reference numeral 10. As shown, each blanket 10 is formed of a plurality of interconnected blocks 12.

For the sake of simplicity, the surfaces of the blocks 12 are shown untextured and plain, although this should not be construed as limiting.

Figure 8:
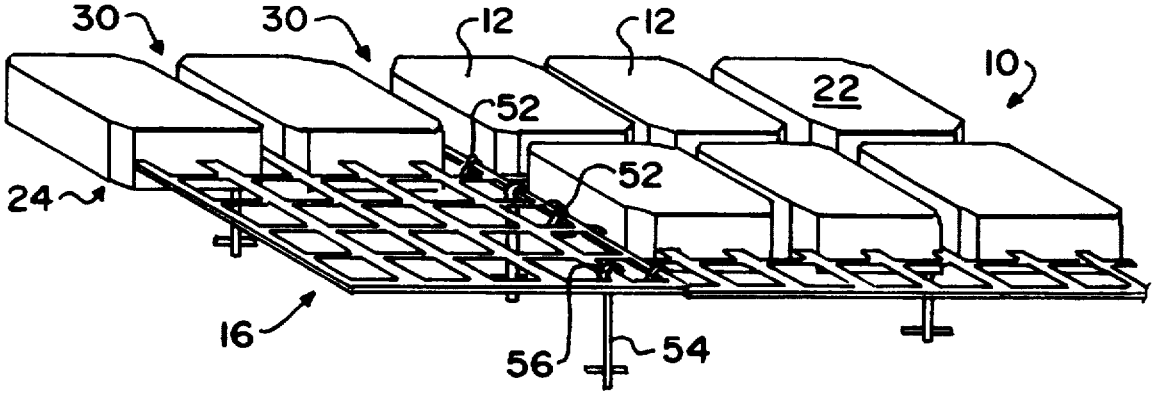
FIG. 8 is a perspective view showing a portion of a further embodiment of two adjacent blankets fixed in adjacent position.

The plurality of blocks 12 is formed into the blanket 10 by each block 12 being joined to an adjacent block 12 during casting of the blocks 10 by a preselected embodiment of an interconnecting reinforcement lattice 16. The adjacent positioning of the blocks 12 may be either contiguous (FIGS. 2 and 3) or spaced apart positioning (FIG. 8), as will be described in greater detail hereinafter.

It will be understood that the blocks 12 may be of any of a plurality of shapes and only a few shapes are shown for simplicity. Thus in FIG. 2, the blocks 12 are hexagonal, in FIG. 3, the blocks 12 are octagonal and in FIG. 8 the blocks 12 are rectangular.

The lattice 16 may take the form of one of several embodiments, each embodiment being preselected to meet the requirements produced by the particular substratum upon which the blanket 10 is to be laid as well as by the intended use of the blanket 10.

The adjacent positioning of the blocks 12 is likewise predicated upon the final effect desired to be produced by the blanket 10 with reference to vegetational growth and further with reference to contour and grade of the underlying substrata. In this respect, as an example, vegetative growth would not be desirable in a driveway while such vegetative ingrowth may be desired along a bank or in a garden.

With respect to qualities of the substrata, such as soil and hydraulic factors, as well as with respect to the load to be placed upon the blanket 10 and/or other application requirements, the various supporting lattice 16 embodiments have been proposed to accommodate virtually any situation which may present itself.

One embodiment of the lattice 16 comprises a underlayment of geotechnical fabric 20 which acts to minimize water channeling between the blocks 12 as well as between adjacent blankets 10, for control of soil erosion.

It will be understood that the blanket 10 is formed using a plurality of molds (not shown) which are filled with the material, such as concrete, from which the blocks 12 are to be formed, with a top surface 22 of each block 12 being created along a bottom surface of the mold and with a bottom surface 24 of each block 12 being accessible during molding, i.e., facing upwardly.

As the concrete is drying within the molds, a layer of the geotechnical fabric underlayment 20 is placed across the bottom surface 24 of a chosen plurality of the drying blocks 12, once the blocks 12 have been positioned to obtain the preselected conformation for the blanket 10 and at an approximate center point of each block the fabric 20 is notched, creating wings 26 which are pushed into the concrete to ensure that the hardening concrete adheres to the underlayment 20, creating the blanket 10 of blocks 12. The blocks 12 can be contiguous or spaced apart, as desired for a particular application and can have various shapes, colors and surface textures, also as desired.

Figure 6:
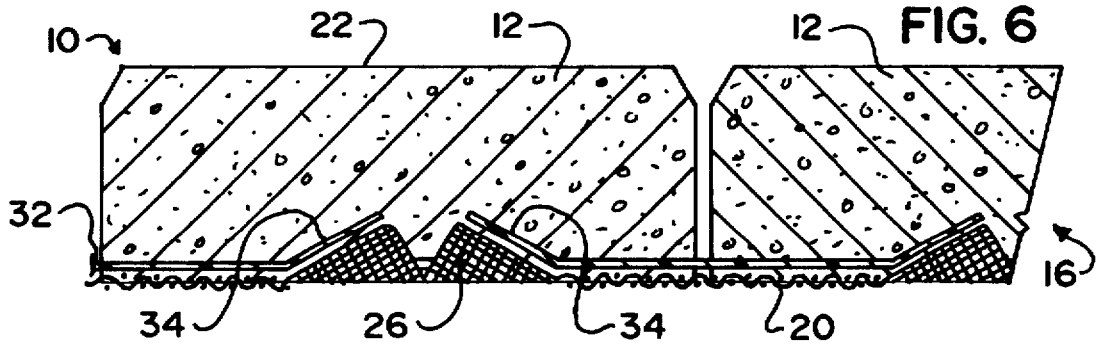
FIG. 6 is similar to FIG. 5 and shows a further combination lattice embodiment.

It will be understood that a very flexibly articulated blanket 10 may be formed using the geotechnical underlayment 20 as the lattice 16, and, when the blocks 12 are in a spaced apart configuration, the gaps 30 may be dimensioned to accommodate the negotiating of various grade and/or contour change requirements of the substrata. Further, the gaps 30 between the blocks 12 may be backfilled with stone, or with soil and vegetation.

Where an increased degree of reinforcement is desired, a second lattice 16 in the form of a flexible matrix material 32 may be used alone as shown in FIG. 1 or with the geotechnical underlayment 20, as shown in FIG. 6. To assure that the geotechnical underlayment 20 adheres to and within the concrete blocks 12 together with the matrix material 32, the two layers of this combination lattice 16 may be notched at approximately centered locations over each block 12, with the wings 26 of the underlayment 20 and wings 34 of the matrix material 32 formed being flexed into the drying concrete in nested configuration to assure adherence.

Further, where strong reinforcement is desired for the blanket 10 such as when used for heavy load bearing application or where the substrata cannot be counted on for support (noncompactible base), a grid of flexible or rigid tubular members 38, such as steel cable or steel tubing may be used to form the lattice 16, with or without a layer of geotechnical underlayment 20.

Figure 7:
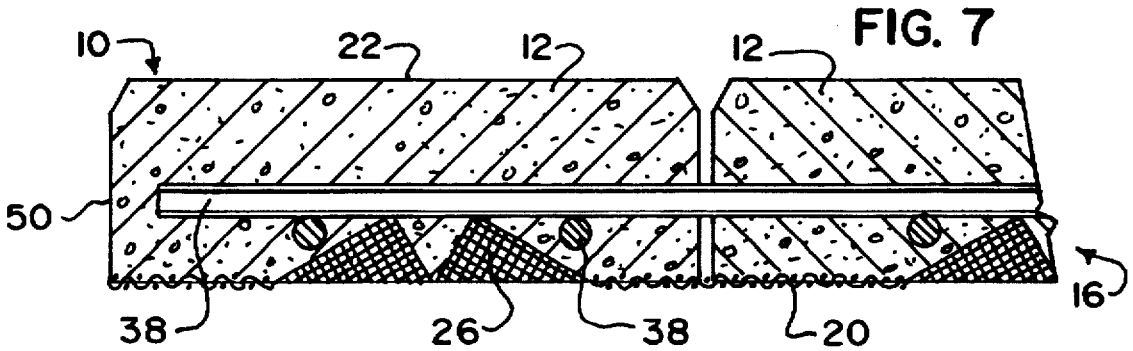
FIG. 7 is similar to FIG. 6 and shows a further combination lattice embodiment.
Figure 9:
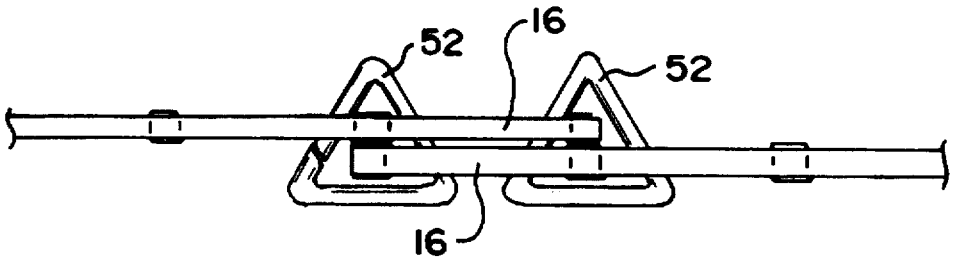
FIG. 9 is an enlarged view of the clips used to join the adjacent blankets of FIG. 8 together.

In this embodiment, the block molds are first positioned to obtain the desired configuration for the blanket 10 and a plurality of tubular reinforcing members 38 are dropped into slots for same in mold sidewalls, directionally layered as shown in FIGS. 4 and 7, with concrete then being poured to secure the formed blocks 12 to the grid 38. It will be understood that the grid does not extend past any end edges 40 of a blanket 10 whereas the matrix material 32 and underlayment 20 preferably do extend therepast.

The blanket 10 may be of any shape or size, and may be easily positioned with a tractor loader, at rates up to 400 sq. ft. or 200 linear feet per hour, by one or two unskilled laborers using a spreader bar. It has been found that preformed blankets 10 of 4'×8' or 4'×12' are suitable for most applications.

The blanket may also be produced on site if needed, at rates up to 300 or more square feet per hour.

It will be understood that a plurality of blankets 10 may be placed adjacent each other to create the desired final configuration, such as for a driveway.

Depending upon the substrata, the interfit of blocks 12 along the end edges 50 of each blanket 10 may maintain contiguous positioning.

If desired, such as when a shifting substrate is present, the blankets 10 may be engaged to one another by engaging clips 52 to overlying areas of the lattice 16 which extend past the blanket edges 50, as shown. Further, to assure that the blankets 10 remain stationary relative to the substrate, elongate anchors 54 having an eye 56 engaged to the lattice 16 may be driven into the ground along the edges 50 of the blanket 10 or in any gaps 30 between the blocks 12.

It will be understood that labor and time are saved when laying such erosion control block structure by having a chosen plurality of blocks 12 joined together to save labor and time over first manually laying the geotechnical layer and then manually laying the blocks thereover individually by hand.

Also, the blanket 10 with its various defined lattices 16 can accommodate substantially any substrate, making the blanket 10 very versatile.

As described above, the blanket 10 of the present invention provides a number of advantages, some of which have been described above and others of which are inherent in the invention. Also, modifications may be proposed to the blanket 10 without departing from the teachings herein.

Accordingly, the scope of the invention is only to be limited as necessitated by the accompanying claims.

I claim:

1. A blanket of concrete blocks having a preselected configuration and having blocks thereof adhered to and held together by at least a first reinforcing lattice extending across a bottom surface of the blanket and to edges of the blanket, the blocks being positioned adjacent to one another with gaps therebetween, and adhering to the at least first reinforcing lattice by having wings of lattice underlying each block flexed into the concrete of each block during production thereof.

2. The blanket of claim 1 wherein the reinforcing lattice is a geotechnical underlayment.

3. The blanket of claim 1 wherein the reinforcing lattice is a flexible matrix material.

4. The blanket of claim 1 wherein the reinforcing lattice is a grid of tubular structures which are layered according to direction.

5. The blanket of claim 1 wherein the reinforcing lattice is geotechnical material underlayment in combination with flex matrix material.

6. The blanket of claim 1 wherein the reinforcing lattice is geotechnical material underlayment in combination with tubular grid.

7. The blanket of claim 1 wherein said blocks are contiguous to one another.

8. The blanket of claim 1 wherein said blocks are spaced from one another.

9. The blanket of claim 1 wherein said blocks are hexagonal.

10. The blanket of claim 1 wherein said blocks are rectangular.

11. The blanket of claim 1 wherein said blocks are octagonal.

12. An erosion control system created from a plurality of blankets of concrete blocks having a preselected configuration and having the blocks thereof adhered to and held together by at least one reinforcing lattice extending across a bottom surface of the blocks and at least to edges of the blanket, such blankets being configured to have end edges of lattice which are matable with end edges of lattice of any adjacent blanket to produce any desired configuration for the system without interruption to a preselected block pattern.

* * * * *